US006641098B1

(12) United States Patent
Proffitt

(10) Patent No.: US 6,641,098 B1
(45) Date of Patent: Nov. 4, 2003

(54) THIN WALLED SHELF FIXTURE

(75) Inventor: Ronnie Lee Proffitt, Hamilton, OH (US)

(73) Assignee: MED division of Hirsh Industries, Inc., Cambridge City, IN (US)

( * ) Notice: Subject to any disclaimer, the term of this patent is extended or adjusted under 35 U.S.C. 154(b) by 0 days.

(21) Appl. No.: 10/153,110

(22) Filed: May 22, 2002

(51) Int. Cl.[7] ..... A47G 29/02

(52) U.S. Cl. ..... 248/243; 108/108; 211/59.2; 248/242

(58) Field of Search ..... 248/242, 243, 248/246, 247, 558, 550, 250, 903; 108/108, 152, 105, 6, 1; 211/59.2, 187

(56) References Cited

U.S. PATENT DOCUMENTS 3,089,675 A * 5/1963 Lozier ..... 248/242
3,248,079 A * 4/1966 Kennedy ..... 248/242
3,300,170 A * 1/1967 Raffa ..... 248/242
3,538,860 A * 11/1970 Fisher ..... 108/1
3,602,472 A * 8/1971 Smyth-Tyrrell ..... 248/242
4,008,873 A 2/1977 Travaglio et al. ..... 248/242
4,307,671 A * 12/1981 Albano ..... 108/6
4,674,723 A 6/1987 Bayuk ..... 248/246
5,205,421 A * 4/1993 Bustos ..... 211/59.2
6,499,608 B1 * 12/2002 Sterling et al. ..... 211/70.6

* cited by examiner

*Primary Examiner*—Anita King
*Assistant Examiner*—Tan Le
(74) *Attorney, Agent, or Firm*—Woodard, Emhardt, Moriarty McNett & Henry LLP

(57) ABSTRACT

An adjustable shelf assembly. A shelf bracket is removably mounted to a post and has a horizontally extending position and an inclined position. The post includes a plurality of slots separated by embossed ribs that, in turn, receive fingers at the proximal end of the shelf bracket. The lower edge of the bracket is deeply recessed with an adjacent embossment. The bracket and post are thin walled.

8 Claims, 3 Drawing Sheets

THIN WALLED SHELF FIXTURE

BACKGROUND OF THE INVENTION

The present invention relates generally to the field of shelf brackets and associated posts.

DESCRIPTION OF THE PRIOR ART

Commercial shelves include vertically extending posts with a plurality of vertically arranged slots receiving the proximal end of shelf brackets cantileveredly mounted thereto. The brackets include a plurality of fingers at the proximal end that project into the slots allowing the shelf resting atop the fixture to be adjusted to and from a horizontal position and an inclined position. For example, U.S. Pat. No. 4,008,873 discloses an angularly adjustable shelf bracket having a plurality of fingers at its proximal end that project into a slotted post or in the bracket to be adjusted to and between a plurality of different angular positions.

Another adjustable shelf assembly is disclosed in U.S. Pat. No. 4,674,723 wherein the shelf bracket includes a plurality of resilient finger portions extendable into elongated slots of a vertically extending box channel support post.

Yet another prior art shelf fixture is shown in FIG. 1. The shelf bracket includes four approximate end fingers extendable into a slotted box channel. Two separate shelf brackets are shown and mounted to the post of FIG. 1 with the top bracket being in the horizontal position whereas the bottom bracket is positioned in an inclined position. The top three fingers of each bracket have downwardly opening recesses or slots receiving the front wall of the post thereby releasably locking the shelf bracket in a horizontal position. At the same time, the bottom or fourth finger abuts the outwardly facing surface of the front wall of the post. In the inclined position, the front wall of the post is not positioned in the finger slots or recesses and instead an upper stop surface on the top finger abuts interiorly the post front wall while the bottom most finger projects into the post.

I have improved the prior art brackets shown in FIG. 1 in two aspects. First, the lower edge portion of top bracket 10 will interfere with object 11 resting atop bracket 12 even though bracket 12 is in the inclined position. Therefore, there is a need to provide a deep recess in the lower edge of the shelf bracket in order to maximize the storage space therebeneath. Due to the cantilever mounting of the bracket, such a deep recess weakens the prior bracket. I have provided a new bracket disclosed in FIG. 2 having a deep recesses in the lower edge thereof to maximize storage therebeneath and have maintained the strength of the bracket by embossing the lower recess bracket edge.

The prior post and shelf brackets are produced from relatively heavy material. For example, the wall thickness of the prior post is typically 0.187 inches of high strength material. My new post utilizes medium strength material having a wall thickness of 0.105 inches. Likewise, the wall thickness of sheet metal shelf bracket 10 shown in FIG. 1 is typically 13 gauge or 0.108 inches whereas the wall thickness of the new bracket shown in FIG. 2 is 14 gauge or 0.078 inches.

In order to achieve the wall thickness of the shelf bracket while maintaining the required bracket strength, I have added the embossment to the lower edge of the shelf bracket. Brackets 10 and 12 (FIG. 1) are held to the post via the ribs 14 extending between adjacent holes 15 through which the bracket fingers extend. In order to reduce the wall thickness of post 13 including the thickness of ribs 14, the new design includes horizontally extending embossments on the ribs. The resultant weight reductions in the long post with the attached shelf brackets are very substantial with the aforementioned improvements. Likewise, the estimated cost savings using the improved post and shelf brackets is 20–30 percent.

SUMMARY OF THE INVENTION

One embodiment of the present invention is a support for a shelf comprising a vertical post having a vertical front wall with an outwardly facing surface and an inwardly facing surface. The front wall has a plurality of openings spaced along the length thereof that extend through the outwardly facing surface and the inwardly facing surface. The front wall includes a plurality of horizontally extending cross ribs with a separate cross rib being located between each of the openings. The cross ribs are embossed forming a front embossed surface and a rear embossed surface spaced apart a distance equal to the front wall thickness. A shelf bracket has a distal end and a proximal end with a plurality of proximal fingers extending from the proximal end into the openings. The fingers are arranged to contact the vertical post allowing the shelf bracket to be adjusted relative to the post from a first position to support the shelf in a horizontal position to a second position to support the shelf in an inclined position. The bracket includes a vertical extending sheet metal main body with a lower edge forming a downwardly facing recess to minimize interference with items placed therebeneath. The main body has an embossed edge portion extending along the recess from the bottom most of the fingers toward the distal end.

It is an object of the present invention to provide a new and improved shelf system.

A further object of the present invention is to provide an adjustable shelf assembly that maximize the storage space therebeneath.

In addition, it is an object of the present invention to provide an adjustable shelf assembly produced from thinner material as compared to the prior shelf assemblies while maintaining shelf strength.

Related objects and advantages of the present invention will be apparent from the following description.

DESCRIPTION OF THE PREFERRED EMBODIMENT

Figure 1:
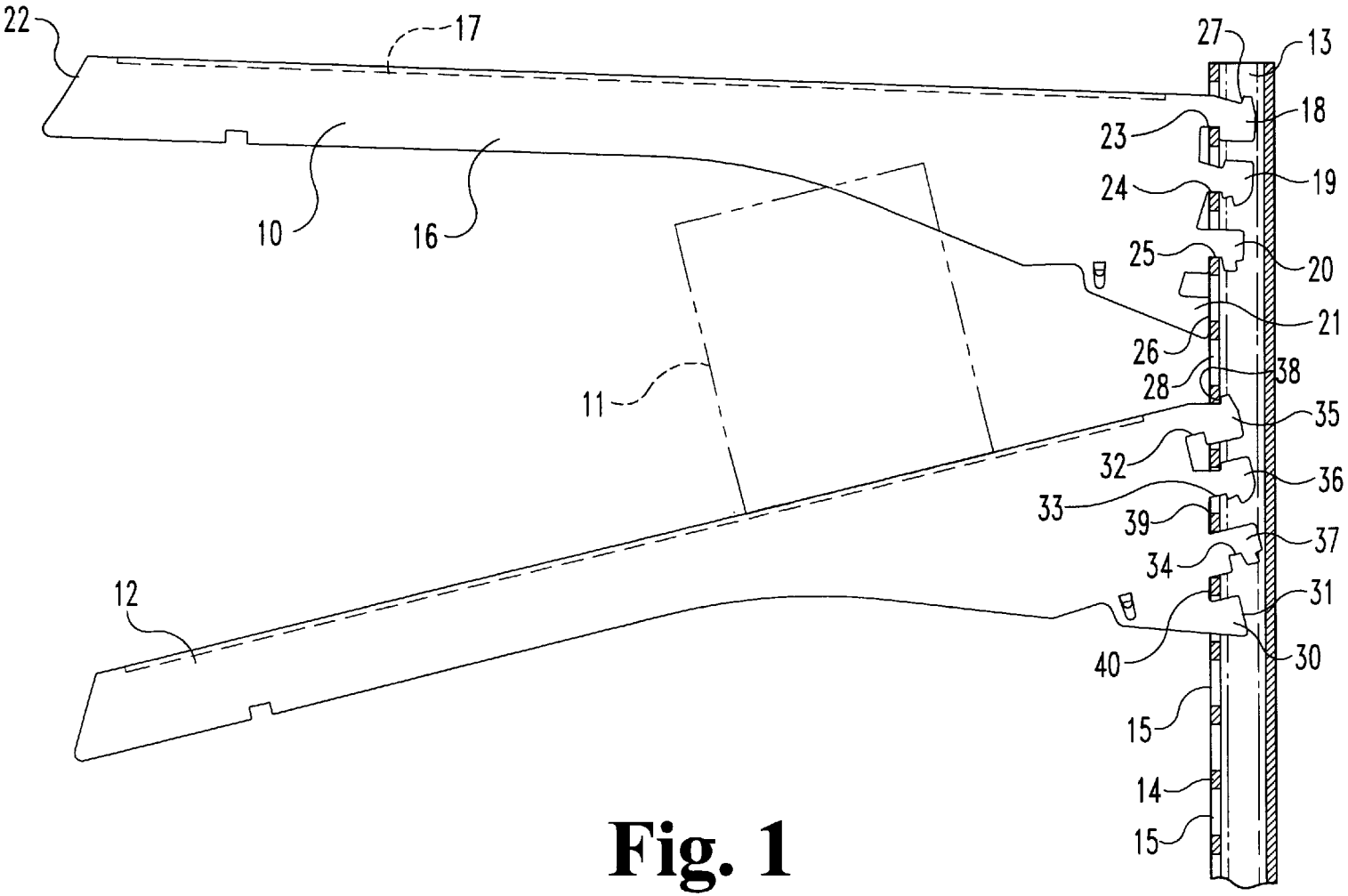
Fig. 1 (Prior Art)
FIG. 1 is a fragmentary cross-sectional view of a prior art adjustable shelf assembly.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown the prior adjustable shelf assembly. The assembly includes a bracket 10 cantileveredly mounted to a post 13. A second identical bracket 12 is also shown mounted to the post only in a downwardly inclined position.

Brackets 10 and 12 are identical and include a sheet metal main body 16 that extends vertically and is integrally joined to a horizontally extending top wall 17 upon which a shelf rests. Four fingers 18–21 are integrally connected to the proximal end of bracket 10 with top wall 17 extending between the proximal end and the distal end 22. Fingers 18, 19 and 20 have respectively downwardly opening recesses or slots 23, 24 and 25. The bottom finger 21 has a vertically extending edge 26. The top finger 18 has a notch 27 forming a generally upwardly facing stop surface.

Post 13 extends vertically and is configured as an elongated hollow box channel with an outwardly facing front wall 28 with a plurality of slots 15 formed thereon. Ribs 14 extend horizontally between each slot. Each rib has a flat outwardly facing front surface and a flat inwardly facing rear surface.

When the prior shelf bracket is in the horizontal position as illustrated for bracket 10, ribs 14 extend into recesses 23–25 and vertical edge 26 of the bottom finger 21 contacts the outwardly facing flat surface of one of the ribs 14. The bracket is adjustable to a downwardly inclined position as illustrated for bracket 12 in FIG. 1. In this position, the bottom finger 30 of bracket 12 extends into one of the slots with the distal edge 31 of finger 30 being positioned entirely within post 13. The downwardly opening recesses or slots 32–34 of respectively fingers 35–37 are located apart from ribs 14 so that the ribs do not project into and are not held within the slots or recesses. The upwardly facing notch 38 of top finger 35 contacts and receives one of the ribs. Edges 39 and 40 extending respectively between fingers 36 and 37 and 37 and 30 each contact a rib 14 thereby securing bracket 12 in the downwardly inclined position.

Figure 2:
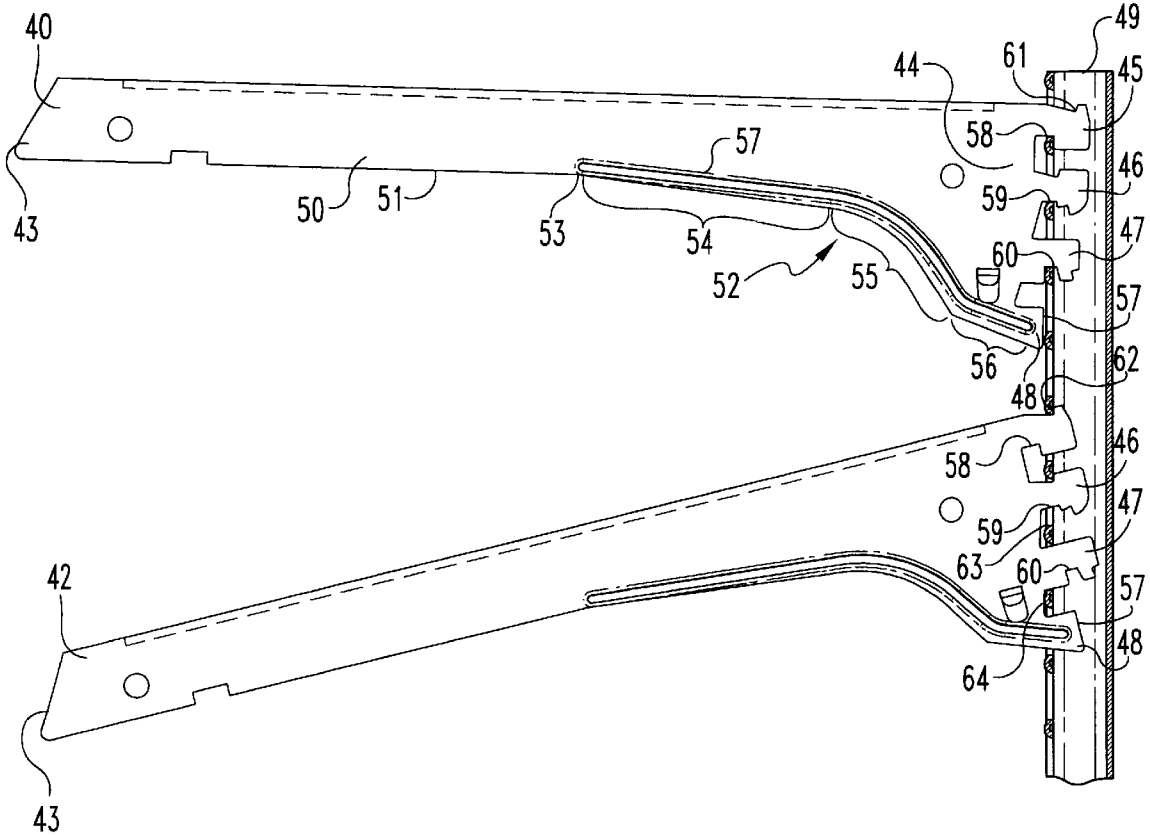
FIG. 2 is a fragmentary cross-sectional view of the improved adjustable shelf assembly.

The improved shelf bracket of FIG. 2 is identical to the shelf bracket of FIG. 1 with exception that the sheet metal main body is considerably reduced in thickness in the improved version and with the additional exception that the lower recessed edge is deeply recessed having an embossment thereon. Likewise, the improved vertically extending post of FIG. 2 is identical to the post of FIG. 1 with the exception that the improved post has a considerably reduced wall thickness and with the additional exception that the ribs extending between adjacent slots are embossed.

Brackets 40 and 42 (FIG. 2) are identical with bracket 40 being shown in a first position for supporting a horizontally extending shelf and with bracket 42 being shown in a second position supporting the shelf in a downwardly inclined position. Bracket 40 will now be described it being understood that an identical description applies to bracket 42. Bracket 40 has a distal end 43 and a proximal end 44 with four fingers 45, 46, 47 and 48 extendable from proximal end 44 into openings or slots formed in the vertically extending post 49. The fingers are arranged to contact the vertical post allowing the shelf bracket to be adjusted relative to the post from the first position shown for bracket 40 to the second position shown for bracket 42.

Bracket 40 includes a vertically extending sheet metal main body 50 extending to and between ends 43 and 44. The lower edge 51 forms a downwardly facing recess 52 to minimize interference with items stored on shelf 42 and positioned beneath bracket 40. Recess 52 extends from approximately the midway point 53 between ends 43 and 44 and has a gradually downwardly slanted straight edge portion 54 and a concave deeply recessed portion 55 located between portion 54 and the downwardly slanted, straight edge portion 56. Portion 54 extends downwardly at a relatively straight angle as is the case with portion 56. The straight edge portion 56 extends from the tip of finger 48 through approximately 1/10 the length of bracket 40 with the deeply recessed portion 55 extending through approximately 2/10 the length of bracket 40. The lower edge 51 is embossed thereby forming a continuous embossment 57 extending from point 53 to finger 48. Finger 48 includes a vertically extending edge 57 that contacts and rests against one of the ribs when bracket 40 is in the horizontal position.

Fingers 45–48 each include respectively downwardly opening recesses or slots 58, 59 and 60 into which the ribs of post 49 are located when the bracket is in the first or horizontal position. On the other hand, when the bracket is in the downwardly inclined position such as shown for bracket 42, the ribs are located apart from the downwardly opening recesses or slots 58–60. A notch 61 is formed in the top edge of top finger 45 with the notch providing a stop surface 62 for engaging a rib when the bracket is located in the downwardly inclined position. On the other hand, notch 61 and its associated stop surface is located apart from the rib when the bracket extends in the horizontal position. Likewise, when the bracket is in the downwardly inclined position, the bottom most finger 48 projects completely into the post with edges 63 and 64 extending respectively between fingers 46 and 47 and 47 and 48 contacting the ribs when the shelf bracket is in the downwardly inclined position. Bottom finger 48 is positioned entirely outward of post 49 when the shelf bracket extends in the horizontal position.

In order to move the bracket from the downwardly inclined position as illustrated for bracket 42 in FIG. 2 to the horizontal position illustrated by bracket 40 in FIG. 2, distal end 43 of the bracket is moved upwardly with the bracket being pivoted about top finger 45 until bottom finger 48 is located outwardly of the post. The bracket is then allowed to fall downwardly with the ribs extending into recesses 58–60. In order to move the bracket from the horizontal position illustrated by bracket 40 to the downwardly inclined positioned illustrated by bracket 42, the bracket is moved as a unit upwardly until the ribs are located apart from recesses 58–60 and bottom finger 48 is aligned with one of the post openings. Distal end 43 may then be pivoted downward allowing finger 48 to extend into the post and notch 61 to engage the adjacent rib.

Figure 3:
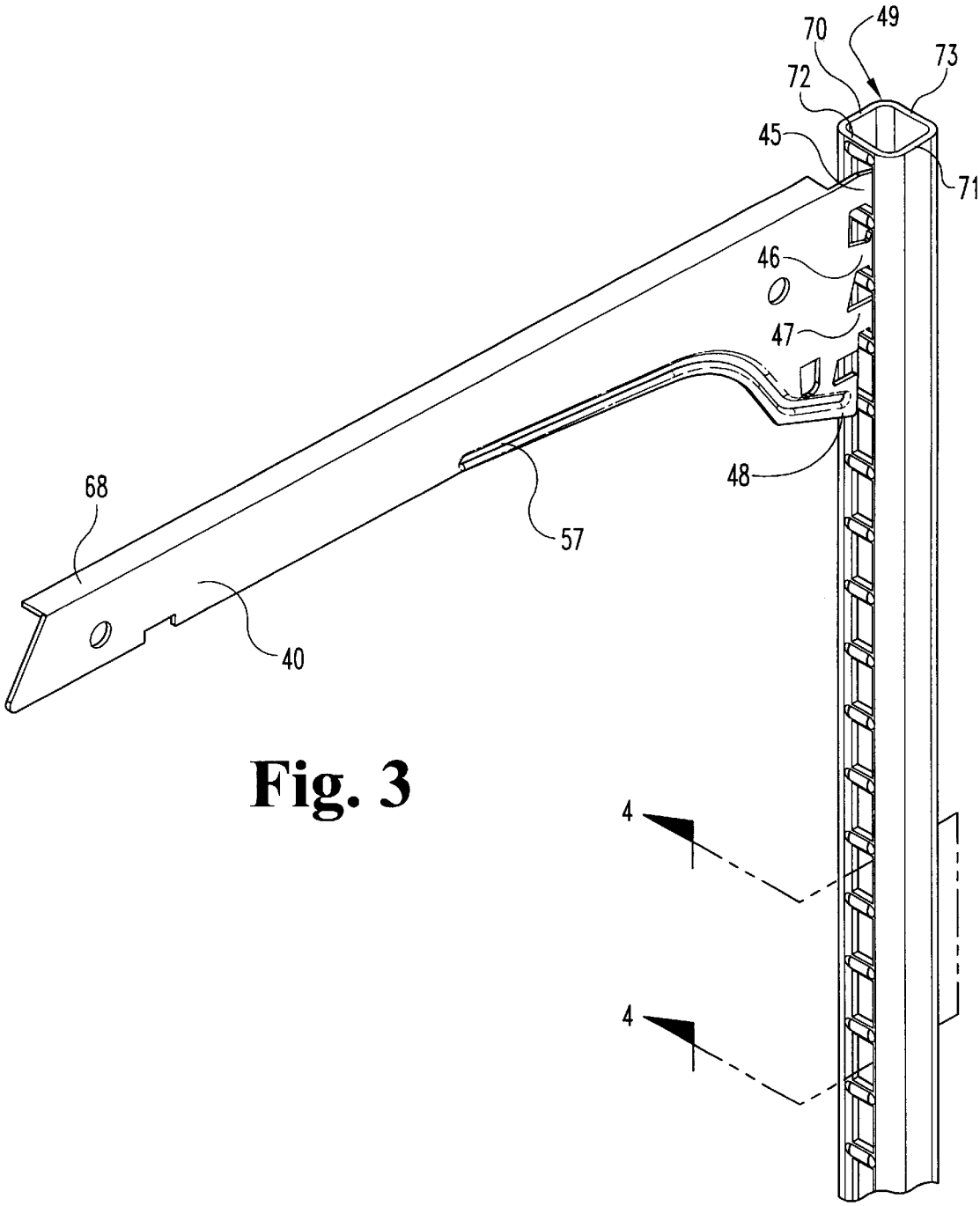
FIG. 3 is a fragmentary perspective view of one of the shelf brackets of FIG. 2 mounted to the post.

Shelf bracket 40 is a multi-position, one-piece, rigid bracket having vertically spaced fingers extendable into the post for supporting engagement with the post ribs. The bracket includes wall 68 (FIG. 3) integrally attached to the vertically extending sheet metal main body of the bracket with wall 68 extending to and between ends 43 and 44.

Figure 4:
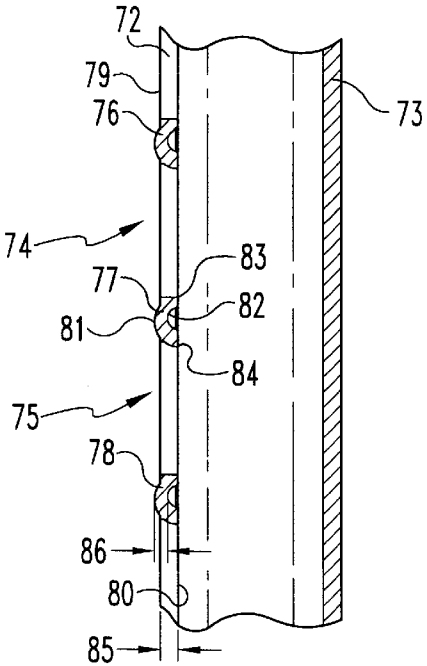
FIG. 4 is an enlarged cross-sectional view of the post of FIG. 2 taken along a line and viewed in the direction of arrows 4—4 of FIG. 3.

Post 49 includes a pair of vertically extending sidewalls 70 and 71 connected together by a front wall 72 and a back wall 73. The walls are spaced apart forming a hollow interior into which the shelf bracket fingers project. Front wall 72 has a forwardly or outwardly facing front surface 79 (FIG. 4) and a rearwardly or inwardly facing rear surface 80. A plurality of slots or openings extend through wall 72 into the hollow interior of post. A rib is positioned between each pair of slots. For example, slots 74 and 75 are shown in FIG. 4 being separated apart by rib 77. The top of slot 74 is defined by rib 76 whereas the bottom of slot 75 is defined by rib 78.

Wall 72 extends on the opposite vertically extending sides of each slot. The ribs are embossed forming a convex outer surface. For example, rib 77 is horizontally embossed forming a convex outwardly facing surface 81 and a concave inwardly facing surface 82. Surface 81 forms a ridge and surface 82 forms a pair of edges 83 and 84 extending respectively across the top portion and bottom portion of the rib. Surface 82 is located between the outwardly facing surface 79 of front wall 72 and the rearwardly facing surface 80 of the front wall whereas surface 81 is located outwardly of surface 79. When the shelf bracket is in the horizontal position, vertical surface or edge 57 of bottom finger 48 contacts ridge 81 of the rib. Further, the stop surfaces 63 and 64 extending between respectively fingers 46 and 47 and fingers 47 and 48 contact the ridges 81 of the adjacent rib. The thickness 85 of front wall 72 equals the thickness 86 of each rib.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A support for a shelf comprising:

a vertical post having a vertical front wall having thickness with an outwardly facing surface and an inwardly facing surface spaced apart an amount equal to said thickness, said front wall having a plurality of openings spaced along the length thereof and extending through said outwardly facing surface and said inwardly facing surface, said front wall including a plurality of horizontally extending cross ribs with a separate cross rib being located between each of said openings, said cross ribs being embossed forming a convex front embossed for wall strength with minimal thickness surface and a concave rear embossed surface spaced apart a distance equal to said thickness; and, a shelf bracket having a distal end and a proximal end with a plurality of proximal fingers extending from said proximal end into said openings, said fingers arranged to contact said vertical post allowing said shelf bracket to be adjusted relative to said post from a first position to support a shelf in a horizontal position to a second position to support said shelf in an inclined position, said bracket including a vertical extending sheet metal body with a lower edge forming a downwardly facing deep to minimize interference with items placed therebeneath, for maximizing storage space therebeneath said body having an embossed edge portion extending along said recess from said bottom most of said fingers toward said distal end; and wherein:

said fingers include a top finger with an upper stop surface and a downwardly opening slot, said fingers further include a bottom finger with an upwardly extending edge, said bracket when in said first position has one of said cross ribs located in said slot while said upwardly extending edge of said bottom finger rests upon said front embossed surface of one of said ribs;

said bracket when in said second position has said upper stop surface positioned against said rear embossed surface of one of said ribs while said bottom finger projects into one of said slots, said fingers includes an upwardly extending stop surface between said top finger and said bottom finger with said upwardly extending stop surface contacting said front embossed surface of one of said ribs;

said rear embossed surface of each rib is located between said outwardly facing surface and said inwardly facing surface of said front wall with said front embossed surface being convex in shape.

2. The support of claim 1 wherein:

said fingers include a middle finger located between said top finger and said bottom finger, each of said fingers include a downwardly opening slot into which said front wall is located when said shelf bracket is in said first position and said bottom finger rests upon said front embossed surface of one of said ribs.

3. An adjustable shelf assembly to support a shelf in a horizontal position and an inclined position comprising:

an elongated, hollow, box channel support member having a outwardly facing front wall with a plurality of slots formed thereon and horizontally extending ribs separating said slots from each other, said ribs having top and bottom rib edges defining with said front wall said slots with said ribs further having embossments thereon forming an outer embossed surface and an inner embossed surface; and, a multi-position, one-piece rigid shelf bracket member having a first position to support a shelf in a horizontal position and a second position to support a shelf in an inclined position, said bracket member having a proximal end with a plurality of vertically spaced retaining fingers extendable into said slots for supporting engagement with said ribs and with respect to which said bracket member is adjustable to and from said first position and said second position, said fingers including a top finger and a bottom finger with said top finger having a top stop surface and a downwardly opening recess into which one of said ribs fit when said top finger projects into said slots and said bottom finger is entirely positioned outwardly of said box channel support member having an edge resting against said outer embossed surface of one of said ribs and holding said bracket member in said first position and said shelf in said horizontal position, said bracket member being movable upwardly and pivotably downwardly from said first position to said second position to support said shelf in an inclined position with said bottom finger projecting into one of said slots and said downwardly opening recess moving apart from said ribs and said top stop surface of said top finger engaging said inner embossed surface; and wherein:

said outer embossed surface is convex forming a ridge and said inner embossed surface is concave forming a pair of edges located within said support member, said fingers include a middle finger located between said top finger and said bottom finger, each of said fingers include a downwardly opening recess into which said front wall is located when said shelf bracket is in said first position and said bottom finger rests upon said front embossed surface of one of said ribs.

4. The shelf assembly of claim 3 wherein:

said bracket includes a vertically extending sheet metal main body with a distal end and a lower edge forming a downwardly facing main body recess to minimize interference with items placed therebeneath, said main body having an embossed edge portion extending along said main body recess from said bottom finger toward said distal end.

5. An adjustable shelf assembly to support a shelf in a horizontal position and an inclined position comprising:

an elongated, hollow, box channel support member having a outwardly facing front wall with a plurality of slots formed thereon and horizontally extending ribs separating said slots from each other, said ribs having top and bottom rib edges defining with said front wall said slots with said ribs further having an outer surface and an inner surface; and, a multi-position, one-piece rigid shelf bracket member having a first position to support a shelf in a horizontal position and a second position to support a shelf in an inclined position, said bracket member having a proximal end with a plurality of vertically spaced retaining fingers extendable into said slots for supporting engagement with said ribs and with respect to which said bracket member is adjustable to and from said first position and said second position, said fingers including a top finger and a bottom finger with said top finger having a top stop surface and a downwardly opening recess into which one of said ribs fit when said top, finger projects into said slots and said bottom finger is entirely positioned outwardly of said box channel support member having an edge resting against said outer surface of one of said ribs and holding said bracket member in said first position and said shelf in said horizontal position, said bracket member being movable upwardly from said first position to said second position to support said shelf in an inclined position with said bottom finger projecting into one of said slots and said downwardly opening recess moving apart from said ribs and said top stop surface of said top finger engaging said inner surface, said bracket member having a sheet metal, vertically extending wall with distal end and a lower deeply recessed edge extending from said distal end to said proximal end, said lower recessed edge being embossed from said bottom finger toward said distal end; and wherein:

said outer surface is embossed and convex forming a ridge and said inner surface is embossed and concave forming a pair of edges located within said support member, said fingers include a middle finger located between said top finger and said bottom finger, each of said fingers include a downwardly opening recess into which said front wall is located when said shelf bracket member is in said first position and said bottom finger rests upon said outer surface of one of said ribs.

6. A support for a shelf comprising:

a vertical post having a vertical front wall having thickness with an outwardly facing surface and an inwardly facing surface spaced apart, said front wall having a plurality of openings spaced along the length thereof and extending through said outwardly facing surface and said inwardly facing surface, said front wall including a plurality of horizontally extending cross ribs with a separate cross rib being located between each of said openings, said cross ribs being embossed forming a convex front embossed surface and a concave rear embossed surface; for wall strength with minimal thickness and, a shelf bracket having a distal end and a proximal end with a plurality of proximal fingers extending from said proximal end into said openings, said fingers arranged to contact said vertical post allowing said shelf bracket to be adjusted relative to said post from a first position to support a shelf in a horizontal position to a second position to support said shelf in an inclined position; said bracket including a downwardly facing deep recess to minimize interference with items placed therebeneath while maximizing storage space therebeneath and wherein:

said fingers include a top finger with an upper stop surface and a downwardly opening slot, said fingers further include a bottom finger with an upwardly extending edge, said bracket when in said first position has one of said cross ribs located in said slot while said upwardly extending edge of said bottom finger rests upon said front embossed surface of one of said ribs;

said bracket when in said second position has said upper stop surface positioned against said rear embossed surface of one of said ribs while said bottom finger projects into one of said slots, said fingers includes an upwardly extending stop surface between said top finger and said bottom finger with said upwardly extending stop surface contacting said front embossed surface of one of said ribs;

said rear embossed surface of each rib is located between said outwardly facing surface and said inwardly facing surface of said front wall with said front embossed surface being convex in shape.

7. An adjustable shelf assembly to support a shelf in a horizontal position and an inclined position comprising:

an elongated, hollow, box channel support member having a outwardly facing front wall with a plurality of slots formed thereon and horizontally extending ribs separating said slots from each other, said ribs having top and bottom rib edges defining with said front wall said slots with said ribs further having embossments thereon forming a convex outer embossed surface and a concave inner embossed surfacefor wall strength with minimal thickness; and, a multi-position, one-piece rigid shelf bracket member having a first position to support a shelf in a horizontal position and a second position to support a shelf in an inclined position, said bracket member having a proximal end with a plurality of vertically spaced retaining fingers extendable into said slots for supporting engagement with said ribs and with respect to which said bracket member is adjustable to and from said first position and said second position, said fingers including a top finger and a bottom finger with said top finger having a top stop surface and a downwardly deep opening recess to minimize interference with items placed therebeneath while maximizing storage space therebeneath into which one of said ribs fit when said top finger projects into said slots and said bottom finger is entirely positioned outwardly of said box channel support member having an edge resting against said outer embossed surface of one of said ribs and holding said bracket member in said first position and said shelf in said horizontal position, said bracket member being movable upwardly and pivotably downwardly from said first position to said second position to support said shelf in an inclined position with said bottom finger projecting into one of said slots and said downwardly opening recess moving apart from said ribs and said top stop surface of said top finger engaging said inner embossed surface; and wherein:

said embossments are rounded forming ridges, said shelf bracket when in said first position has said bottom finger resting upon one of said embossments.

8. An adjustable shelf assembly to support a shelf in a horizontal position and an inclined position comprising:

an elongated, hollow, box channel support member having a outwardly facing front wall with a plurality of slots formed thereon and horizontally extending ribs separating said slots from each other, said ribs having top and bottom rib edges defining with said front wall said slots with said ribs further having a convex outer surface and a concave inner surface for wall strength with minimal thickness; and, a multi-position, one-piece rigid shelf bracket member having a first position to support a shelf in a horizontal position and a second position to support a shelf in an inclined position, said bracket member having a proximal end with a plurality of vertically spaced retaining fingers extendable into said slots for supporting engagement with said ribs and with respect to which said bracket member is adjustable to and from said first position and said second position, said fingers including a top finger and a bottom finger with said top finger having a top stop surface and a downwardly opening deep recess to minimize interference with items placed therebeneath while maximizing storage space therebeneath into which one of said ribs fit when said top finger projects into said slots and said bottom finger is entirely positioned outwardly of said box channel support member having an edge resting against said outer surface of one of said ribs and holding said bracket member in said first position and said shelf in said horizontal position, said bracket member being movable upwardly from said first position to said second position to support said shelf in an inclined position with said bottom finger projecting into one of said slots and said downwardly opening recess moving apart from said ribs and said top stop surface of said top finger engaging said inner surface, said bracket member having a sheet metal, vertically extending wall with distal end and a lower deeply recessed edge extending from said distal end to said proximal end, said lower recessed edge being embossed from said bottom finger to a location approximately midway between said bottom finger to said distal end; and wherein:

said outer surface is embossed forming a ridge, said shelf bracket member when in said first position has said bottom finger resting upon said outer surface.

* * * * *